United States Patent [19]

Boskovic

[11] Patent Number: 4,754,972

[45] Date of Patent: Jul. 5, 1988

[54] MULTI-LEVEL ROTARY MAZE

[76] Inventor: Boris Boskovic, 2102 Bannockburn, Inverness, Ill. 60067

[21] Appl. No.: 915,983

[22] Filed: Oct. 6, 1986

[51] Int. Cl.[4] ..... A63B 67/14; A63F 9/06

[52] U.S. Cl. ..... 273/113; 273/153 S

[58] Field of Search ..... 273/113, 153 S

[56] References Cited

U.S. PATENT DOCUMENTS

| | | | |
|---|---|---|---|
| 558,066 | 4/1896 | Happersett | 273/113 |
| 3,028,704 | 4/1962 | Rumbaugh | 273/118 R |
| 4,008,895 | 2/1977 | Reiner et al. | 273/113 |
| 4,376,537 | 3/1983 | Yokoi | 273/153 S |
| 4,413,823 | 11/1983 | Breslow | 273/153 S |
| 4,487,417 | 12/1984 | Engel | 273/153 S |
| 4,545,577 | 10/1985 | Randleman | 273/113 |
| 4,657,255 | 4/1987 | Seres | 273/153 S |

*Primary Examiner*—Richard C. Pinkham
*Assistant Examiner*—Gary Jackson
*Attorney, Agent, or Firm*—Lee & Smith

[57] ABSTRACT

A multilevel rotary maze comprising a series of stacked maze elements which are rotatable relative to one another. Each of the elements has a series of apertures, at least one of the apertures passing therethrough, and at least a portion of the apertures define a serpentine path throughout the maze which can be attained upon selective sequential rotation of the maze elements to align predetermined apertures thereof. A ball is located in the maze to pass through the apertures as they are aligned.

10 Claims, 2 Drawing Sheets

Figure 6:
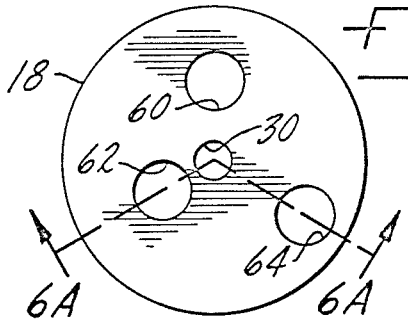
Figure 6A:
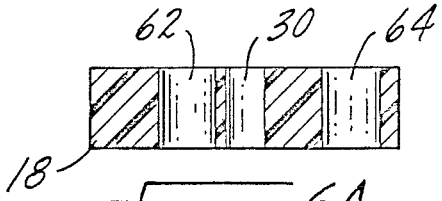

Fig. 1.
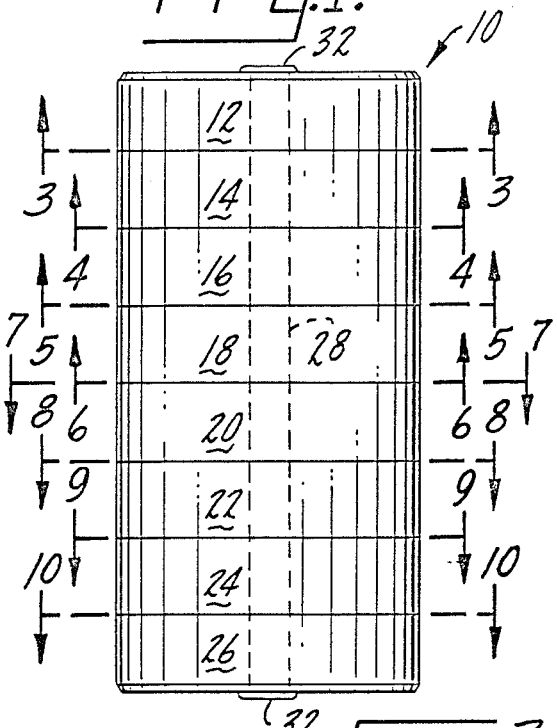
Fig. 2.
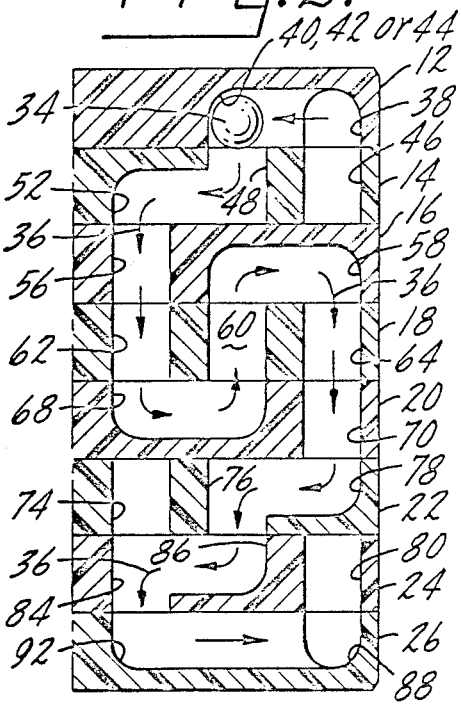
Fig. 3.
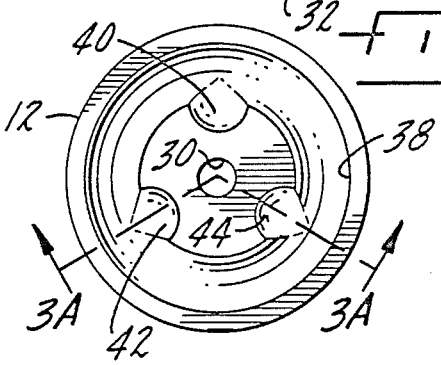
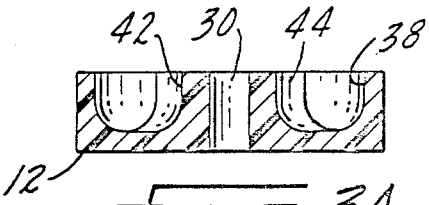
Fig. 3A.
Fig. 4.
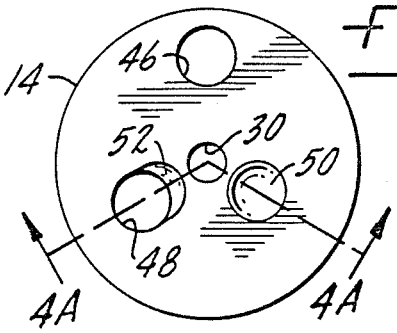
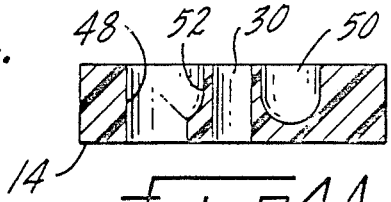
Fig. 4A.
Fig. 5.
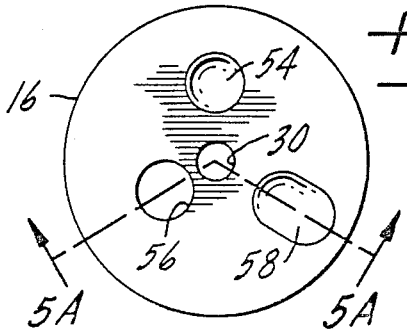
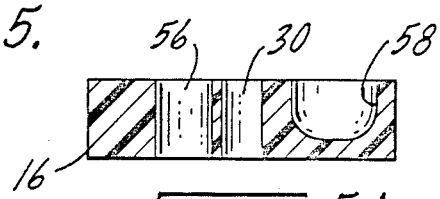
Fig. 5A.

MULTI-LEVEL ROTARY MAZE

BACKGROUND OF THE INVENTION

This invention relates to mazes, and in particular to a rotary-multilevel maze having a serpentine solution path or sequence for passing a traveling element from one end of the maze to the other.

The maze of the invention is intended to be sold as a toy for amusement purposes. Common mazes currently in existence comprise many different types and structures. The most simple, single-dimensional maze, is one employing a tilting planar surface having a path passing periodically adjacent to or between apertures in the surface of the maze. A ball traversing the maze will fall through one of the apertures unless the skill of the operator causes the ball to traverse a serpentine path. In a variation on a concept of a single level maze, U.S. Pat. No. 3,406,971 discloses a multi-level maze which requires the operator to cause a ball to traverse a labyrinth path in three dimensions.

U.S. Pat. No. 4,376,537 discloses a rotary puzzle which requires shifting of puzzle elements. The elements are a series of balls maintained in aligned axial holes thoughout the body of the device. A variation is found in U.S. Pat. No. 3,610,628 which requires rotation of stacked elements until a ball hole is aligned for passing a ball vertically through a direct path from the top to the bottom thereof. Yet another, and simpler, variation is found in U.S. Pat. No. 772,281 which provides a device having a series of rotatable plates at spaced intervals. The plates have a series of holes and depressions therein in order to either pass a ball therethrough or capture the ball in one of the depressions.

None of the prior art provides a rotary type of maze with a challenging serpentine solution path extending from one end of the maze to the other, with the passageways of the path being attained only by rotation of the maze elements to align certain of the elements and the apertures therewithin. With the recent popularity of rotatable alignment-type toys, a more difficult and challenging rotary maze is required.

SUMMARY OF THE INVENTION

The invention provides a rotary maze which comprises a plurality of stacked maze elements in an assembly having first and second ends. Each of the maze elements is rotatable relative to an adjacent maze element and the elements are retained in an aligned orientation about a common axis. A plurality of apertures is formed in each of the maze elements, with at least one of the apertures in each maze element passing through the elements, and at least a portion of the apertures defining a serpentine path throughout the maze upon selective rotation of the maze elements to align certain selected apertures of the maze elements. A traveler in the form of a ball is disposed in the maze and is shaped to pass through the apertures between the first and second ends.

In accordance with the preferred embodiment of the invention, the maze elements are cylindrical. A central bore passes through each of the maze elements, and a rod passes through the bores and is secured at opposite ends of the maze in order to retain the maze elements in a rotatable fashion.

A cap is located at each end of the stack of maze elements, each cap being sealed to prevent escape of the traveler from the maze. Each end cap has an annular internal channel and at least one maze access opening extending between the channel and the assembly of maze elements.

Each aperture in each of the maze elements is spaced radially from the central axis of the maze at one of a variety of predetermined locations. In accordance with the described embodiment of the invention, there are three such locations lying on concentric rings.

In order to pass the traveler between apertures at different locations, some of the apertures comprise transfer apertures having a portion extending radially in an associated maze element. The transfer apertures may either be apertures passing through a maze element, or may be apertures in one face thereof. BRIEF DESCRIPTION OF THE DRAWINGS The invention is described in greater detail in the following description of one example embodying the best mode of the invention, taken in conjunction with the drawing figures, in which:

FIG. 1 is an elevational view of the invention with the apertures in each of the elements being omitted for the sake of clarity, FIG. 2 is a schematic illustration of a solution path through the rotary maze from one end thereof to the other, FIGS. 3 through 10 are cross-sectional illustrations taken along respective planes of FIG. 1 showing in plan view the eight elements of the invention, and FIGS. 3A through 10A are respective cross-sectional views of FIGS. 3 through 10 illustrating the apertures therein.

DESCRIPTION OF ONE EXAMPLE EMBODYING THE BEST MODE OF THE INVENTION

A multilevel rotary maze according to the invention is shown generally at 10 in FIG. 1. It is composed of a plurality of stacked maze elements 12, 14, 16, 18, 20, 22, 24 and 26, with the elements 12 and 26 comprising end caps for the maze 10. The respective elevational views in FIGS. 3 through 10 of the maze elements 12 through 26 illustrate the maze elements and their respective apertures in greater detail.

The maze elements 12 through 26 are rotatable relative to one another, and are held in place by means of a rod 28 passing through a central bore 30 (FIGS. 3 through 10) passing through each of the maze elements 12 through 26. The opposite ends of the rod 28 are capped by an expanded screw or rivet 32 bearing against the respective outer faces of the maze elements 12 and 26 in order to retain the stacked maze elements as an assembly.

FIG. 2 illustrates in schematic form a solution path or sequence through the maze elements 12 through 26 for passing a traveling ball 34 from one end of the maze 10 to the other. As will become evident from the description of the individual maze elements as set forth below, alignment of the all of the elements at one time in order to effect the solution path is impossible. Adjacent elements must be aligned sequentially in order to pass the ball 34 between apertures of the elements. Also, FIG. 2 is intended to schematically represent a laterally expanded cross-sectional view of one half of the maze 10. While the various apertures of the maze elements 12 through 26 are shown in their proper respective radial spacing from the central rod 28, as will become evident from the description below, not only do three apertures not appear side-by-side in any one of the maze elements 12 through 26, but also the spacing of the apertures is considerably closer than that illustrated in FIG. 2. The solution path, generally indicated by the reference numeral 36, will be described in somewhat greater detail below following a detailed description of the features of each of the maze elements 12 through 26.

The element 12 comprises one of the end caps for the maze 10, and includes an outer annular internal channel 38 spaced radially from the central bore 30. Access bores 40, 42 and 44 are formed in the element 12 adjacent the channel 38. As explained in somewhat greater detail below, at least one of the access bores 40 through 44 provides an initial access to the next maze element 14 from the channel 38. While the bores 40 through 44 are shown in FIG. 3 at an equal radial spacing from the central bore 30, as will become evident, the spacing need not be equal depending on the difficulty of solution of the maze 10 desired.

Turning next to FIGS. 4 and 4A, the maze element 14 is composed of a solid disc having (in addition to the bore 30) three apertures 46, 48 and 50. As best shown in FIG. 4A, the aperture 50 does not extend through the element 14. The aperture 46, also shown in FIG. 2, passes through the maze element 14 as does the aperture 48. In addition, as illustrated, the aperture 48 includes a jog 52 toward the central bore 30. The purpose of the jog 52 is to permit transfer of the ball 34 from one radial level of the maze 10 to another, as explained below.

As shown in FIG. 4, and in an exaggerated fashion in FIG. 2, the centers of the bores 46, 48 and 50 are located at three different radial distances from the central bore 30, with the aperture 50 having the shortest radial distance, the aperture 48 having the second radial distance, and the aperture 46 having the third. For the purposes of explanation and discussion, and in order to promote simplicity, the first, second and third radial distances from the central bore 30 will be referred to as the first, second and third levels of the maze 10, with the first level being closet to the central bore (e.g., aperture 50), the second level being between the first and the third (e.g., aperture 48) and the third level being the farthest from the central bore (e.g., aperture 46).

If there were no means of access between the three levels of the maze 10, the ball 34 entering the maze at a particular level, such as level two, could traverse the maze 10 only between apertures in the second level. Thus, periodically, certain of the apertures either have jogs, such as the jog 52, or are formed as channels between two or more of the levels, so that the ball 34 can be passed between the levels of the maze 10 as one attempts to cause the ball 34 to travel from one end of the maze 10 to the other. In FIG. 4, the jog 52 permits the ball 34 to be transferred from the second level to the first, or, as shown in FIG. 4A, the ball can exit aperture 48 in the second level since the outlet of the aperture 48 (the top of FIG. 4A) permits exit at either the first or the second levels.

Proceeding to FIG. 5, the maze element 16 is, similar to the maze element 14, fashioned from a solid disc of material, and includes apertures 54, 56, 58. Only the aperture 56 passes through the maze element 16, and the aperture 54 comprises a "dead end" similar to the aperture 50 of the maze element 14, while the aperture 58, although not passing through the maze element 16, permits transfer between the second and the third levels of the maze 10. As shown in FIG. 5, the aperture 56 is located at the first level, the aperture 54 is located at the second level, and the aperture 58 permits transfer between the second and third levels.

The maze element 18 in FIG. 6 is composed of three apertures 60, 62 and 64, all of which pass through the maze element 18. The aperture 62 is located at the first level, the aperture 60 is located at the second level, and the aperture 64 is located at the third level of the maze 10.

Figure 7:
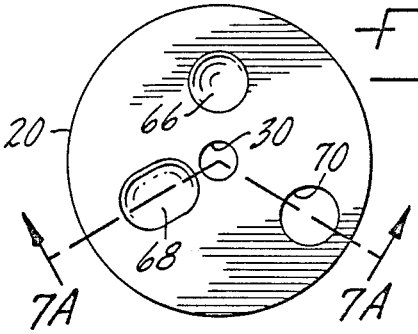
Figure 7A:
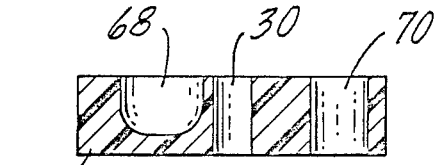

Apertures 66, 68 and 70 are formed in the maze element 20 of FIG. 7. Only aperture 70, located at level three, passes through the maze element 20, while the aperture 66 is a dead end aperture at level two, and the aperture 68 permits transfer between levels two and one.

Figure 8:
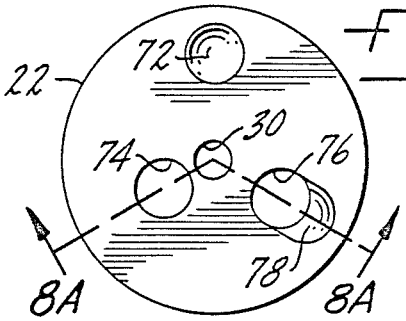
Figure 8A:
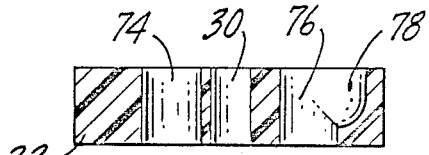
Figure 9:
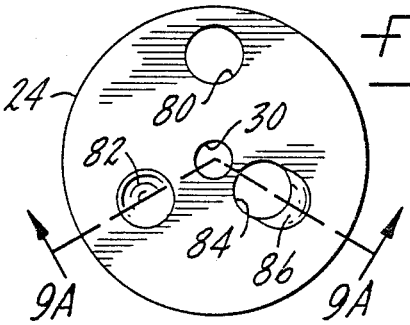
Figure 9A:
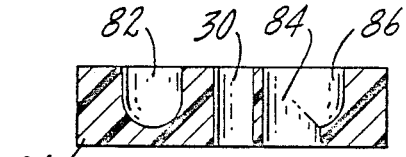
Figure 10:
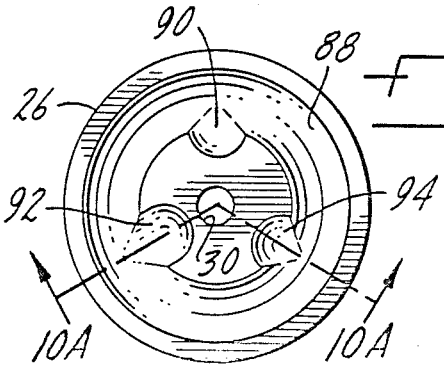
Figure 10A:
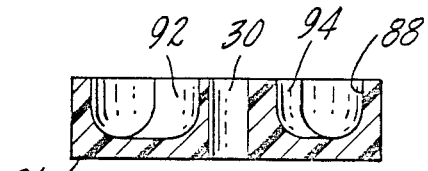

In FIG. 8, apertures 72, 74 and 76 are situated in the maze element 22. The aperture 72 is a dead end aperture located at level three, while the aperture 74 passes through the maze element 22 at level one, and the aperture 76 is located at level two and also includes a jog 78 permitting transfer between levels two and three.

The maze element 24 includes apertures 80, 82 and 84. The aperture 80 passes through the maze element 24 at level three, while the aperture 82 is a dead end aperture at level two, and the aperture 84 passes through the maze element 24 at level one, with a jog 86 between levels one and two.

The final maze element 26 comprises a cap for the opposite end of the maze 10 and includes an annular internal channel 88. Access bores 90, 92 and 94 lead to the channel 88. The channel 88 is located at level three and the access bores 90 and 94 permit transfer between levels two and three, while the access bore 92 permits transfer between the channel 88 at level three and level one.

With the configurations of the various apertures of the maze elements 12 through 26 having been described above in relation of FIGS. 3 through 10, the solution path 36 will now be described in greater detail. It will be recalled that the sections of FIG. 1 taken for FIGS. 3 through 6 are taken from the bottom (in relation to FIGS. 1 and 2), while the sections for FIGS. 7 through 10 are taken from the top. Also, as explained above, FIG. 2 is simply a diagrammatic representation of the solution to the maze 10 based upon the apertures in the various maze elements 12 through 26 and has been exaggerated substantially in the horizontal dimension in order to clearly define the solution path 36. As is quite evident from the locations of the apertures of the various elements 12 through 26, two apertures of one maze element never appear side-by-side at any time. For example, the apertures 46 and 48 never appear side-by-side as shown in FIG. 2, but they do appear individually at different times in the relationships shown depending on the rotation of the maze element 14.

In order to solve the maze 10, beginning with the ball 34 in the channel 38, the ball is transferred to one of the access bores 40, 42 or 44. Rotation of the maze element 12 relative to the maze element 14 (or vice versa) to align the ball 34 with the aperture 48 permits the ball 34 to enter the aperture 48 and transfer to the jog 52. Rotation of the maze element 16 relative to the maze element 14 to align the aperture 56 with the jog 52 permits the ball 34 to then enter the aperture 56. Subsequently, rotation of the maze element 18 to align the aperture 62 with the aperture 56 permits the ball to then enter the aperture 62. Subsequent rotation of the maze element 20 to align the aperture 68 with the aperture 62 permits the ball 34 to then enter the apertrue 68.

When the ball 34 has entered the aperture 68, it has traversed approximately half of the distance between the two ends of the maze 10, all in the downward direction. At this point reversal of the path of travel of the ball 34 is necessary in order to continue through the solution path 36. With the ball 34 in the aperture 68, the maze element 18 is rotated to align the aperture 60 with the aperture 68. The ball 34 is then transferred into the aperture 60, and the maze element 16 is rotated to align the aperture 58 with the aperture 60, permitting the ball 34 to enter the aperture 58. Then, the maze element 18 is again rotated to align the aperture 64 with the aperture 58, permitting the ball 34 to enter the aperture 64. The maze element 20 is then rotated to align the aperture 70, permitting the ball 34 to enter therein, and the maze element 22 is then rotated to permit the ball 34 to enter the jog 78 of the aperture 76, where the ball remains until the element 24 is rotated to align the jog 86 of the aperture 84 with the aperture 76. The ball 34 then enters the jog 86 and is transferred to the aperture 84, where it remains until the access bore 92 is rotated into alignment with the aperture 84, at which time the ball 34 enters the access bore 92 and may be transferred into the channel 88, thus completing the path of travel from the top of the maze 10 to the bottom thereof. The reverse direction is travered in the reverse manner.

As will be evident from the large number of access bores in the maze elements of the maze 10, the solution path 36 is found only on a trial and error basis. Many blind alleys, dummy apertures and false starts can occur throughout the maze 10. For example, in beginning from the maze element 12, if the ball 34 is not transferred to one of the access bores 40, 42 or 44, the ball 34 can enter the bore 46 of the maze element 14. However, as will be seen, none of the bores 54, 56 and 58 of the maze element 16 can be aligned with the bore 46, and therefore the bore 46 is simply a "dead end" or disjointed path in the maze 10. Other such dead ends or disjointed paths can be seen from examination of the various maze elements 12 through 26.

It will be evident that the number of apertures for the ball 34 in each of the maze elements 12 through 26 can be increased or decreased as desired, and the number of levels for transfer of the ball 34, being three in the maze 10, can also be altered by increasing or decreasing as desired. By increasing the number of levels and increasing the number of apertures in each of the maze elements, the complexity of the maze 10 can be increased, thus increasing the difficulty of solution, and providing a greater number of dead ends and disjointed paths which extend through only a portion of the maze 10. Thus, it will be seen that the combinations and permutations of apertures and levels for locations of the apertures is essentially limitless.

In addition, although the maze 10 illustrated in the drawing figures has only a single solution path 36, it will be evident that more than one path can also be provided, depending on the complexity desired. Again, the combinations and permutations of solution paths are practically limitless.

The maze elements for the maze 10 described above are essentially not interchangeable. Depending on the configuration of the apertures, the elements can be made interchangeable so that the rearrangement of the elements will create a different solution path, increasing interest and enjoyment of the maze 10.

The maze 10 has been illustrated as comprising a generally cylindrical configuration with cylindrical maze elements 12 through 26. Not only can the number of maze elements be varied from that shown, but also the exterior configuration of the maze 10 can be altered as desired. Rather than have a circular circumference, each of the maze elements can be square, rectangular, or have any multihedral configuration as may be desired. Also, although a central bore 30 through each of the maze elements 12 through 26 with a rod 28 has been described as the means for maintaining the maze elements rotatable to one another, other configurations of inter-engagement of the maze elements can be employed. Finally, although it is preferred that the maze elements 12 through 26 be only rotatable relative to one another, complex configurations may permit the maze elements to be shifted laterally relative to one another in addition to or in substitution for being rotatable.

The invention provides a captivating and complex maze toy of varying degrees of difficulty. Various changes can be made to the invention without departing from the spirit thereof or scope of the following claims.

What is claimed is:

1. A multilevel maze, comprising a. a plurality of stacked, generally solid maze elements, b. a plurality of apertures forming discrete passages in each of said maze elements, at least one of said apertures in each maze element passing through said maze element, c. a first portion of said apertures comprising pathway apertures and defining a normally disjointed path extending throughout the maze, d. a second portion of said apertures comprising dummy apertures and defining at least one normally disjointed closed passage extending through only part of the maze, e. a traveler shaped to pass through said apertures, and f. means for selectively aligning the apertures of adjacent maze elements for passage of said traveler therebetween.

2. A rotary maze according to claim 1 including an end cap at each end of the stack of maze elements, said caps being sealed to prevent escape of said traveler from the maze.

3. A rotary maze according to claim 2 in which each end cap includes an annular internal channel, and including at least one maze access opening extending between each channel and said assembly.

4. A multilevel maze according to claim 1 in which said maze elements are cylindrical.

5. A multilevel maze according to claim 1 including a central bore through each of said maze elements, and further including a rod passing through said bores and secured at opposite ends of the maze for retaining said elements in a stacked orientation.

6. A multilevel maze according to claim 1 in which each said aperture is spaced radially from a common central axis of said elements at one of a variety of predetermined locations.

7. A multilevel maze according to claim 6 including three such locations lying on concentric rings.

8. A multilevel maze according to claim 1 in which some of said apertures comprise transfer apertures extending between adjacent ones of said predetermined locations.

9. A multilevel maze according to claim 1 in which said traveler comprises a ball.

10. A multilevel maze according to claim 1 in which each of said elements is rotatable about a common axis relative to an adjacent maze element in order to selectively align the apertures of adjacent maze elements.

* * * * *